US008875890B2

(12) United States Patent
Liao et al.

(10) Patent No.: US 8,875,890 B2
(45) Date of Patent: Nov. 4, 2014

(54) MOUTH BLOWN AIR-SEALED BODY WITH AUTOMATICALLY OPENED AIR INLET

(71) Applicants: Air-Bag Packing Co., Ltd., New Taipei (TW); Yaw-Shin Liao, New Taipei (TW)

(72) Inventors: Yaw-Shin Liao, New Taipei (TW); Chieh-Hua Liao, New Taipei (TW)

(73) Assignees: Air-Bag Packing Co., Ltd., New Taipei (TW); Yaw-Shin Liao, New Taipei (TW)

( * ) Notice: Subject to any disclaimer, the term of this patent is extended or adjusted under 35 U.S.C. 154(b) by 22 days.

(21) Appl. No.: 13/913,145

(22) Filed: Jun. 7, 2013

(65) Prior Publication Data

US 2014/0034148 A1 Feb. 6, 2014

(30) Foreign Application Priority Data

Aug. 1, 2012 (TW) ..... 101127866 A

(51) Int. Cl.
*B65D 81/02* (2006.01)
*B65D 81/03* (2006.01)
*B65D 27/12* (2006.01)

(52) U.S. Cl.
CPC ..... *B65D 81/022* (2013.01); *B65D 81/03* (2013.01); *B65D 27/12* (2013.01)
USPC ..... 206/522; 383/3

(58) Field of Classification Search
CPC ..... B65D 81/052; B65D 81/145
USPC ..... 206/522, 591, 594; 137/223, 855, 561 A
See application file for complete search history.

(56) References Cited

U.S. PATENT DOCUMENTS

| | | | | |
|---|---|---|---|---|
| 8,701,888 | B2 * | 4/2014 | Liao | 206/522 |
| 2007/0023315 | A1 * | 2/2007 | Tanaka et al. | 206/522 |
| 2007/0267094 | A1 * | 11/2007 | Liao et al. | 141/114 |

FOREIGN PATENT DOCUMENTS

| | | |
|---|---|---|
| JP | 5-95851 | 12/1993 |
| TW | 587049 B | 5/2004 |

* cited by examiner

*Primary Examiner* — David Fidei
(74) *Attorney, Agent, or Firm* — Muncy, Geissler, Olds & Lowe, P.C.

(57) ABSTRACT

A postal envelope bag having a cushioning function includes two outer films, two inner films, heat resisting materials, transverse heat-sealing lines, longitudinal heat-sealing lines, air columns, neck heat-sealing lines, an air filling passage, air inlets and heat-sealing blocks, where air entering the air-filling port expands the air filling passage, the two outer films are pulled apart outward in a longitudinal direction and are contracted in a transverse direction; the heat-sealing blocks thrusts the two inner films, the portions of the two inner films coated with the heat resisting material are pulled apart outward in the longitudinal direction, and third segments drives the two inner films to open the air inlet as the two outer films are pulled apart outward in the longitudinal direction; after entering the air column, the air presses the second sides of the two inner films to close the air column.

9 Claims, 16 Drawing Sheets

MOUTH BLOWN AIR-SEALED BODY WITH AUTOMATICALLY OPENED AIR INLET

CROSS-REFERENCES TO RELATED APPLICATIONS

This non-provisional application claims priority under 35 U.S.C. §119(a) on Patent Application No, 101127866 filed in Taiwan, R.O.C. on Aug. 1, 2012, the entire contents of which are hereby incorporated by reference.

BACKGROUND OF THE INVENTION

1. Technical Field

The present invention relates to an air-sealed body, and particularly to a mouth-blown air-sealed body with an automatically opened air inlet.

2. Related Art

An air-sealed body is made of resin films, air columns formed by means of heat sealing into an airtight state and an air-filling port for air filling are disposed on the air-sealed body; the air-sealed body taken as a cushioning material can be used in an internal packing after air is filled in the air columns via the air-filling port.

A conventional air-sealed body disclosed in Japanese Utility Model Laid-Open Publication No. H5-95851 entitled as "Fluid Sealing Bag", is configured with an independent check valve on each air column, where an air inlet at the top of each check valve is aligned with a heat-sealing line and all check valves are coupled together; an air-filling passage is expanded to open the check valves after air is filled in the air-filling passage, so the air may be filled in the air column. This kind of structure, however, only allows each air column to be filled with air respectively because the check valves are independent of one another, the simultaneous filling of multiple air columns is impossible. Furthermore, sealing bag manufacturing is very detailed and complicated; since each check valve must be placed on a predetermined position in the air column one by one and heat sealing is then carried out, the check valve cannot be fixed in the air column, or an air inlet at the top thereof is positioned beyond the heat-sealing line sealed by a heat-sealing mold once the placement position of the check valve or the position of the sealing of the heat-sealing mold deviates, which makes it impossible for the air column to be filled with air because the check valve cannot be opened following the expansion of the air-filling passage, even if the air-filling passage is expanded after the air-filling passage is filled with air.

Another air-sealed body structure is disclosed in Taiwan Patent No. 00587049 entitled as "Assembly Structure of Switch Valve of Air-sealed body and Apparatus for Manufacturing Air-sealed body with Switch Valves", where two inner films and one outer film at one side are adopted to adhere to one another together to form a passage of a switch valve for the opening and closing of the entrance of air into the sealed body, and the sealed body is expanded to block the passage after air is filled therein. The patent only describes how to block the air in the sealed body to prevent it from leaking through the switch valve. However, the switch valve will not be pulled apart outward with movement of the two outer films even if the two outer films are pushed by the air and then pulled apart outward when the air is guided into the passage to fill in and expand it. The two inner films will therefore still attach to each other and an air inlet cannot be opened. Obviously, air cannot enter the sealed body automatically according to the design of the patent.

Therefore, how to design a sealed body, which enables a user to easily fill air in a mouth blowing manner, may automatically open an air inlet and continuously fill air so as to save air filling time, may automatically close the air during air filling, and may automatically lock the air after the air is closed, so as to maintain the air not to leak for a long time, is a technical topic with which the inventor of this disclosure and persons skilled in the art must be confronted.

SUMMARY

In view of this, the present invention proposes a mouth-blown air-sealed body with an automatically opened air inlet, including: two outer films, stacked together vertically; two inner films, positioned between the two outer films, where each of the inner films includes a first side and a second side opposite to each other; a plurality of heat resisting materials, coated between the first sides of the two inner films; a plurality of transverse heat-sealing lines, adhering to two sides of the two outer films; a plurality of longitudinal heat-sealing lines, adhering to the two outer films and the two inner films; a plurality of air columns, where each of the air columns is located between the two outer films of two adjacent longitudinal heat-sealing lines; a plurality of neck heat-sealing lines, located between the transverse heat-sealing lines, where each of the neck heat-sealing lines is corresponding to one of the air columns, and is mainly formed of two first segments, two second segments and a third segment, where the two first segments are respectively connected to two adjacent longitudinal heat-sealing lines; the two second segments are respectively connected to the first segments, and extend toward a direction far away the air columns, and at least one part of the two second segments is located at portions of the two inner films coated with the heat resisting materials; and the third segment is connected to the two second segments, and located at the portions of the two inner films coated with the heat resisting materials, and the neck heat-sealing line located at the portions of the two inner films coated with the heat resisting materials adheres to one of the outer films and one of the inner films adjacent to each other; an air filling passage, located at a space in the two outer films between one of the transverse heat-sealing lines and one of the neck heat-sealing lines, and including an air-filling port capable of filling air; a plurality of air inlets, formed at the portions of the two inner films coated with the heat resisting materials, and used for communicating with the air filling passage and the air columns; and a plurality of heat-sealing blocks, adhering to the two outer films and the two inner films by means of heat sealing, and formed at sides of the air inlets, where air entering the air-filling port expands the air filling passage, the two outer films are pulled apart outward in a longitudinal direction and are contracted in a transverse direction; the heat-sealing blocks thrust the two inner films, the portions of the two inner films coated with the heat resisting material are pulled apart outward in the longitudinal direction, and the third segments drive the two inner films to open the air inlet as the two outer films are pulled apart outward in the longitudinal direction; after entering the air column, the air presses the second sides of the two inner films to close the air column.

The heat-sealing blocks are formed through heat sealing at predetermined positions of the air filling passage in advance according to the present invention. When air is filled in to expand the air filling passage, two outer films are pushed by the air and are pulled apart outward. There is a fall of level between the case that the heat-sealing blocks are set and the case that no heat-sealing block is set during air filling, so the air filling enables the two outer films to be pulled apart outward in the longitudinal direction and contracted in the transverse direction. When the two outer films are contracted in the transverse direction, a plurality of heat-sealing blocks thrusts the two inner films, so that portions of the two inner films coated with the heat resisting materials are thrust in the transverse direction and contracted, thereby opening the air inlet. Furthermore, in order to avoid the case that the two inner films are thrust and contracted in the same direction so as to cause the air inlet not to be opened, according to the present invention, the third segment drives the two inner films to be pulled apart outward in the longitudinal direction with two outer films, so that the two inner films are thrust in the transverse direction and pulled apart outward in the longitudinal direction with the two outer films, so as to ensure that the air inlet automatically opens. The air in the air filling passage may is filled into each air column through a plurality of air inlets, and after entering the air column, the air presses the second sides of the two inner films to close the air column.

Preferable embodiments of the present invention and efficacies thereof are illustrated below with reference to accompanying drawings.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
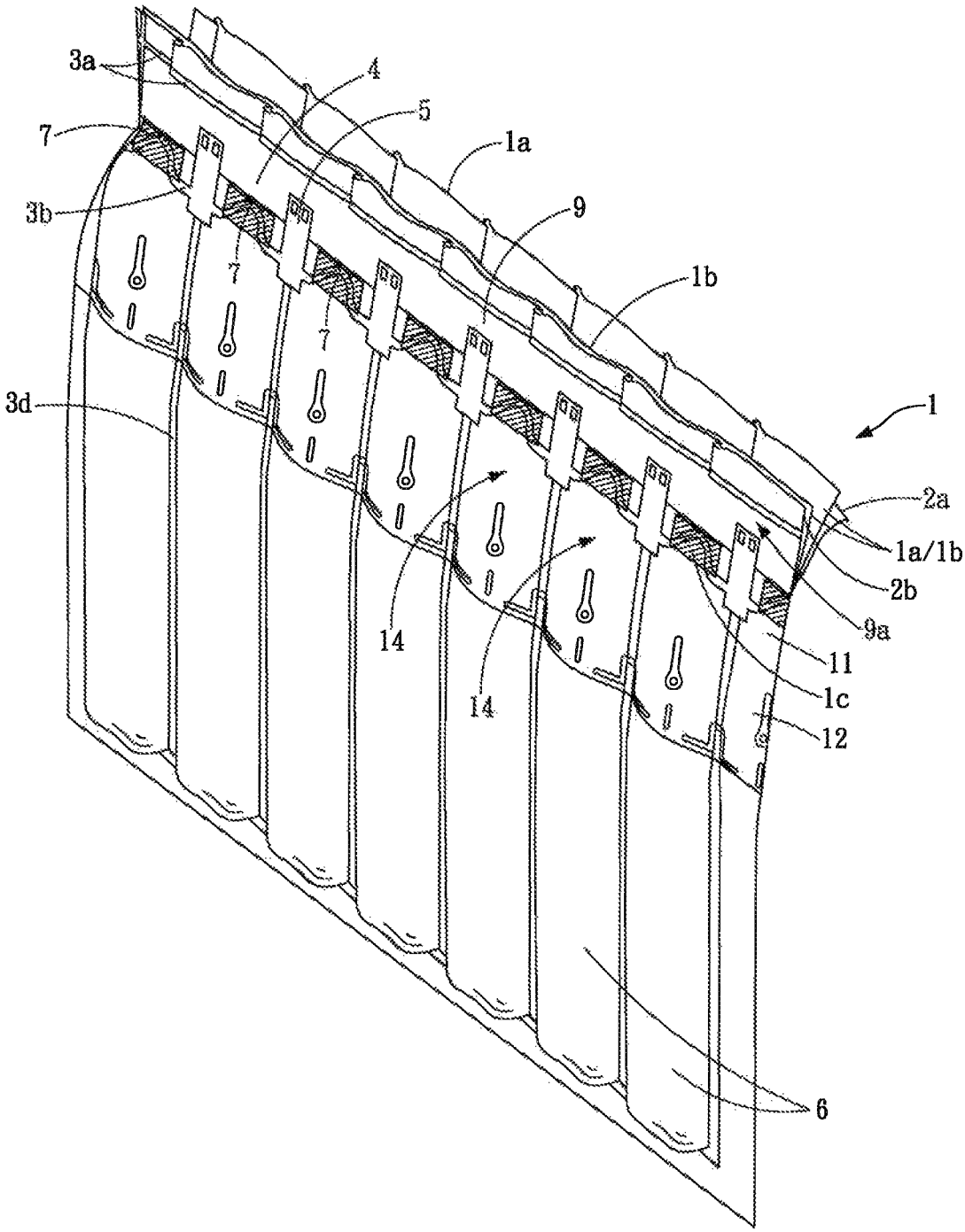
FIG. 1 is a schematic three-dimensional view after air filling according to a first embodiment of the present invention.

Please refer to FIG. 1, FIG. 2A, FIG. 2B, FIG. 3A, FIG. 3B, FIG. 4A and FIG. 4B, a first embodiment of a mouth-blown air-sealed body with an automatically opened air inlet according to the present invention is shown.

A mouth-blown air-sealed body 1 with an automatically opened air inlet of the present invention includes: two outer films 2*a* and 2*b*, two inner films 1*a* and 1*b*, a heat resisting material 1*c*, a plurality of transverse heat-sealing lines 3*a* and 3*b*, a plurality of longitudinal heat-sealing lines 3*d*, a plurality of neck heat-sealing lines 7, an air filling passage 9, a plurality of air columns 6, and a plurality of heat-sealing blocks 5.

The two outer films 2*a* and 2*b* are stacked together vertically.

The two inner films 1*a* and 1*b* are positioned between the two outer films 2*a* and 2*b*, and are disposed at a place slightly lower than the inner top of the two outer films 2*a* and 2*b*, the width of the two inner films 1*a* and 1*b* is the same as that of the two outer films 2*a* and 2*b*, the length thereof is less than that of the outer films 2*a* and 2*b*, and each inner film has a first side 11 and a second side 12 opposite to each other. Furthermore, the two inner films 1*a* and 1*b* are coated with a plurality of heat resisting materials 1*c* (as shown in FIG. 2A), at an interval between the first sides 11, so as to use the heat resisting materials 1*c* as an air passable passage.

Heat sealing is performed along the transverse heat-sealing lines 3*a* and 3*b*, thereby adhering to two sides of the two outer films 2*a* and 2*b*, and heat sealing is performed along the neck heat-sealing line 7, thereby adhering to the two outer films 2*a* and 2*b* and the two inner films 1*a* and 1*b*; therefore, an air passable air filling passage 9 is formed in the two outer films 2*a* and 2*b* between the transverse heat-sealing line 3*a* and the neck heat-sealing line 7, and an air-filling port 9*a* is formed at one end of the air filling passage 9. Heat sealing is performed along the longitudinal heat-sealing line 3*d*, thereby adhering to the two outer films 2*a* and 2*b*, so as to form a plurality of air columns 6 between the two outer films 2*a* and 2*b*. After the heat resisting material 1*c* is coated between the two inner films 1*a* and 1*b*, the two inner films 1*a* and 1*b* adhere to each other by means of heat sealing and a plurality of air inlets 2*e* is formed at places of the two inner films 1*a* and 1*b* connected to the neck heat-sealing line 7, each air inlet 2*e* is corresponding to each air column 6, and continuous air valves capable of simultaneously filling air into the air columns 6 are formed through the two inner films 1*a* and 1*b*.

Figure 2A:
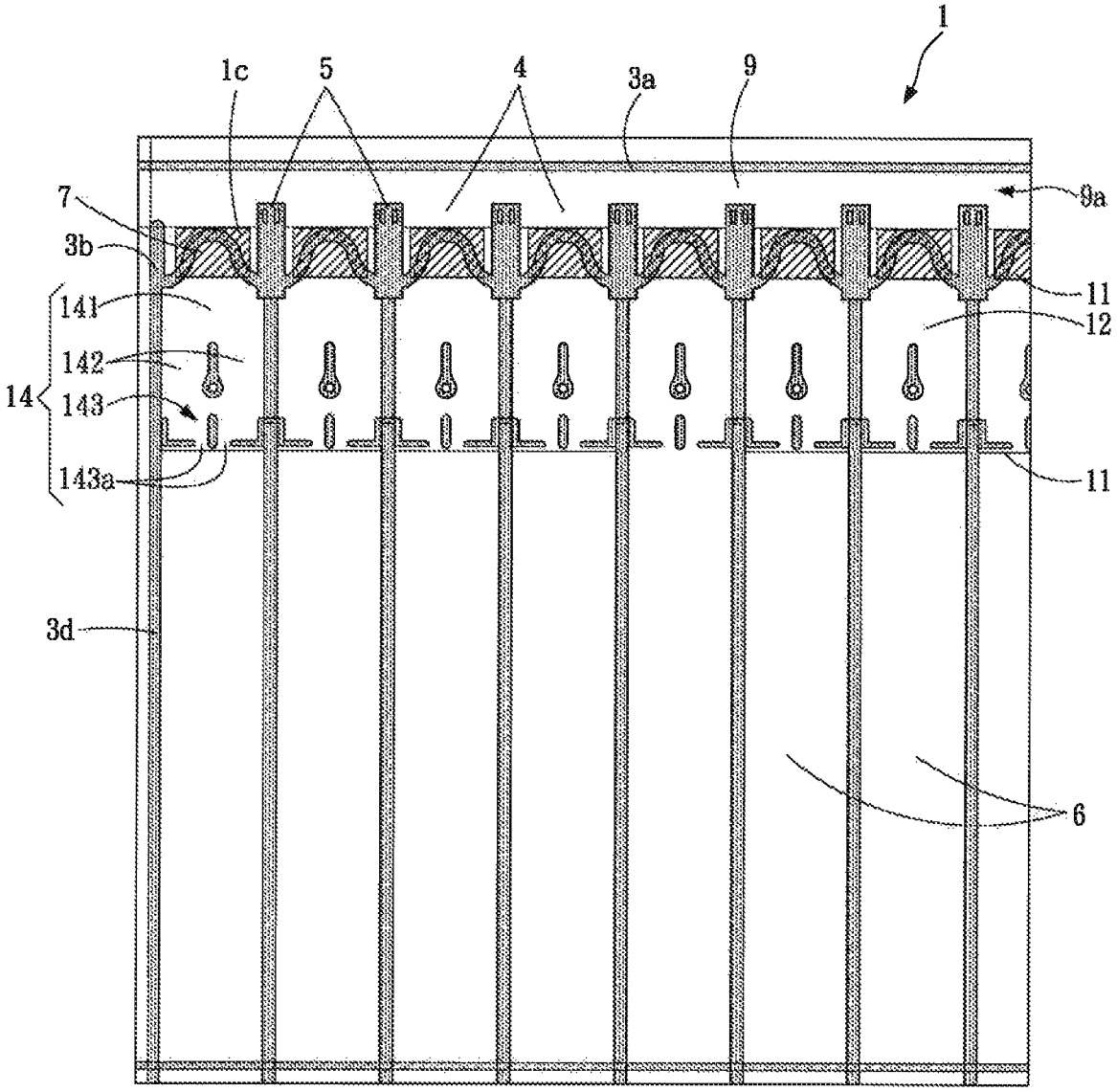
FIG. 2A is a plan view (1) before air filling according to the first embodiment of the present invention.
Figure 2B:
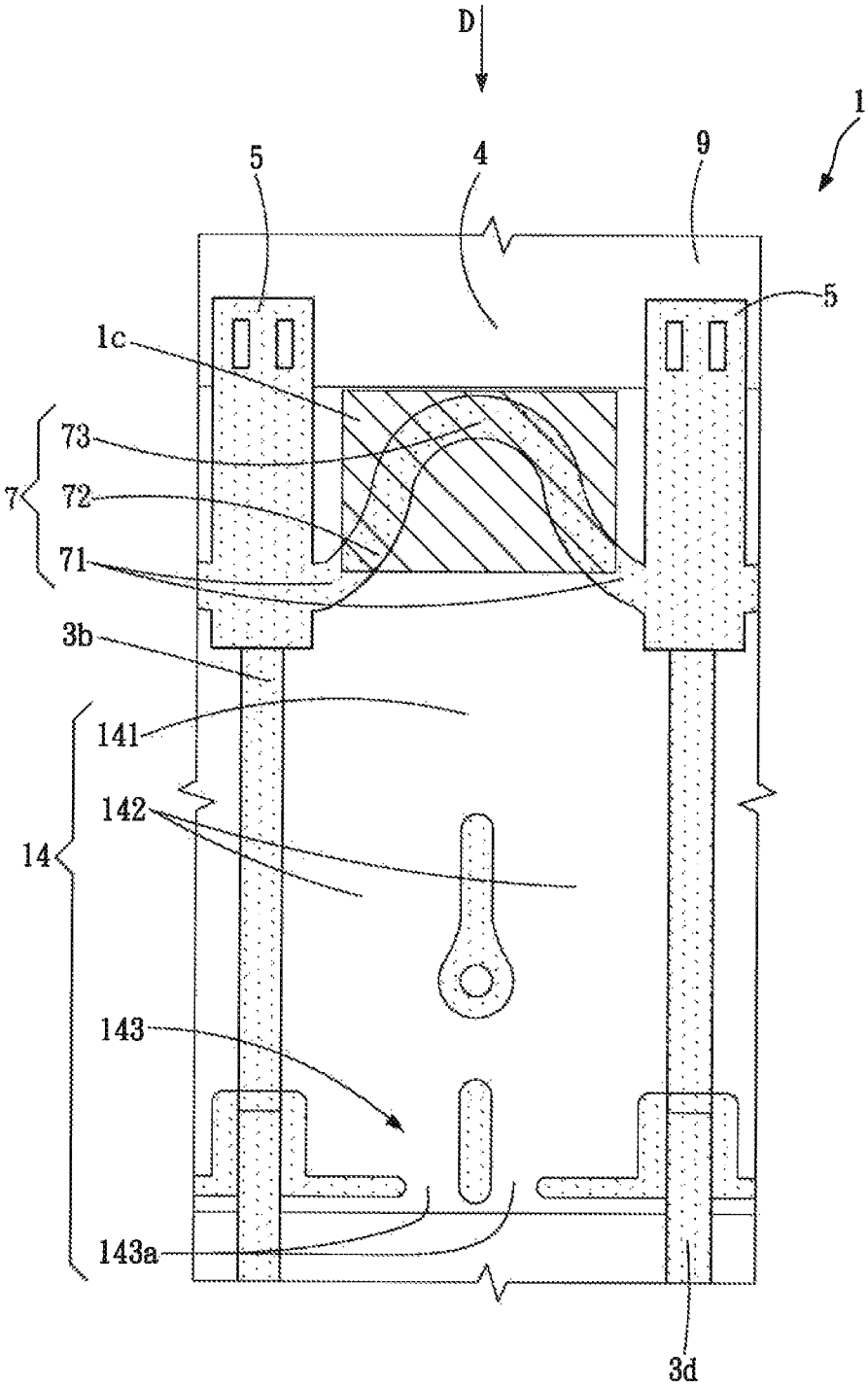
FIG. 2B is a plan view (2) before air filling according to the first embodiment of the present invention.

Herein, the neck heat-sealing line 7 is roughly a curve in an arc shape, and protrudes in a direction from the air column 6 toward the air filling passage 9 (as shown in FIG. 2A), and each neck heat-sealing line 7 is corresponding to an air column 6, and may be mainly formed of two first segments 71, two second segments 72 and a third segment 73 (as shown in FIG. 2B). The two first segments 71 are respectively connected to two adjacent longitudinal heat-sealing lines 3*d*; the two second segments 72 are respectively connected to the first segments 71, and extend toward a direction far away the air columns 6, and at least one part of the two second segments 72 is located at portions of the two inner films 1*a* and 1*b* coated with the heat resisting materials 1*c*, and in other words, the at least one part of the second segments 72 and the portions of the two inner films 1*a* and 1*b* coated with the heat resisting material 1*c* are stacked together; the third segment 73 is connected to the two second segments 72, and is located at the portions of the two inner films 1*a* and 1*b* coated with the heat resisting material 1*c*; as a whole, the third segment 73 is located at the vertex of the arc-shaped curve.

It should be particularly noted that: the neck heat-sealing line 7 located at the portion of the two inner films 1*a* and 1*b* coated with the heat resisting material 1*c* adheres to the outer film 2*a* and the inner film 1*a* adjacent to each other, and adheres to the outer film 2*b* and the inner film 1*b* adjacent to each other, and the inner film 1*a* and the inner film 1*b* do no adhere to each other at the heat resisting material 1*c*. The neck heat-sealing line 7 adheres to the two outer films 2*a* and 2*b* and the two inner films 1*a* and 1*b* simultaneously at the portion coated without any heat resisting material 1*c*; in other words, the neck heat-sealing line 7 adheres to four films simultaneously at the portion coated without any heat resisting material 1*c*.

Figure 4A:
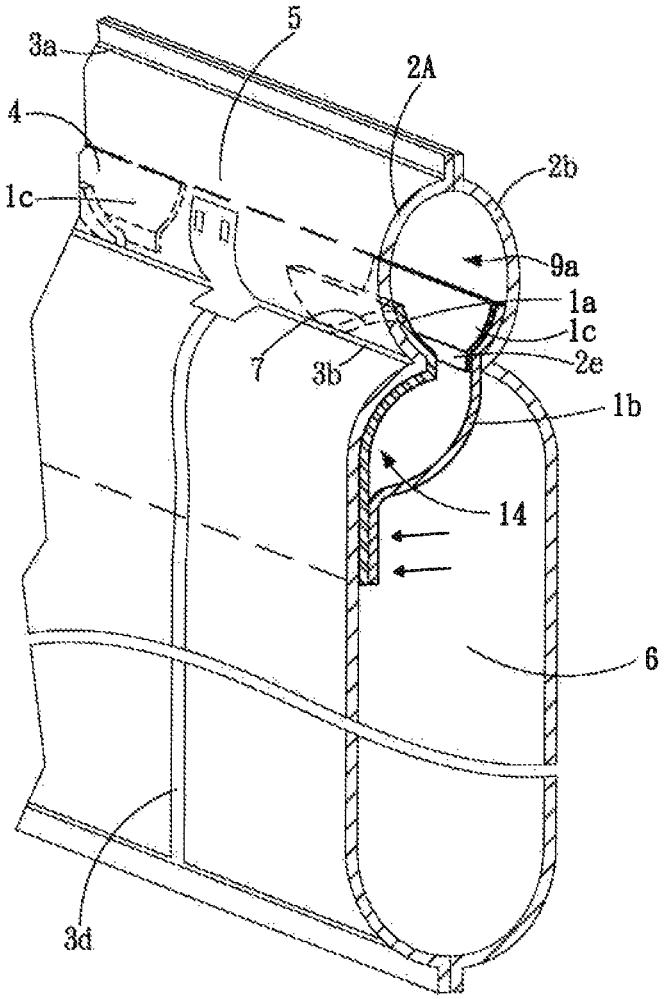
FIG. 4A is a schematic cross-sectional view after air filling according to the first embodiment of the present invention.
Figure 4B:
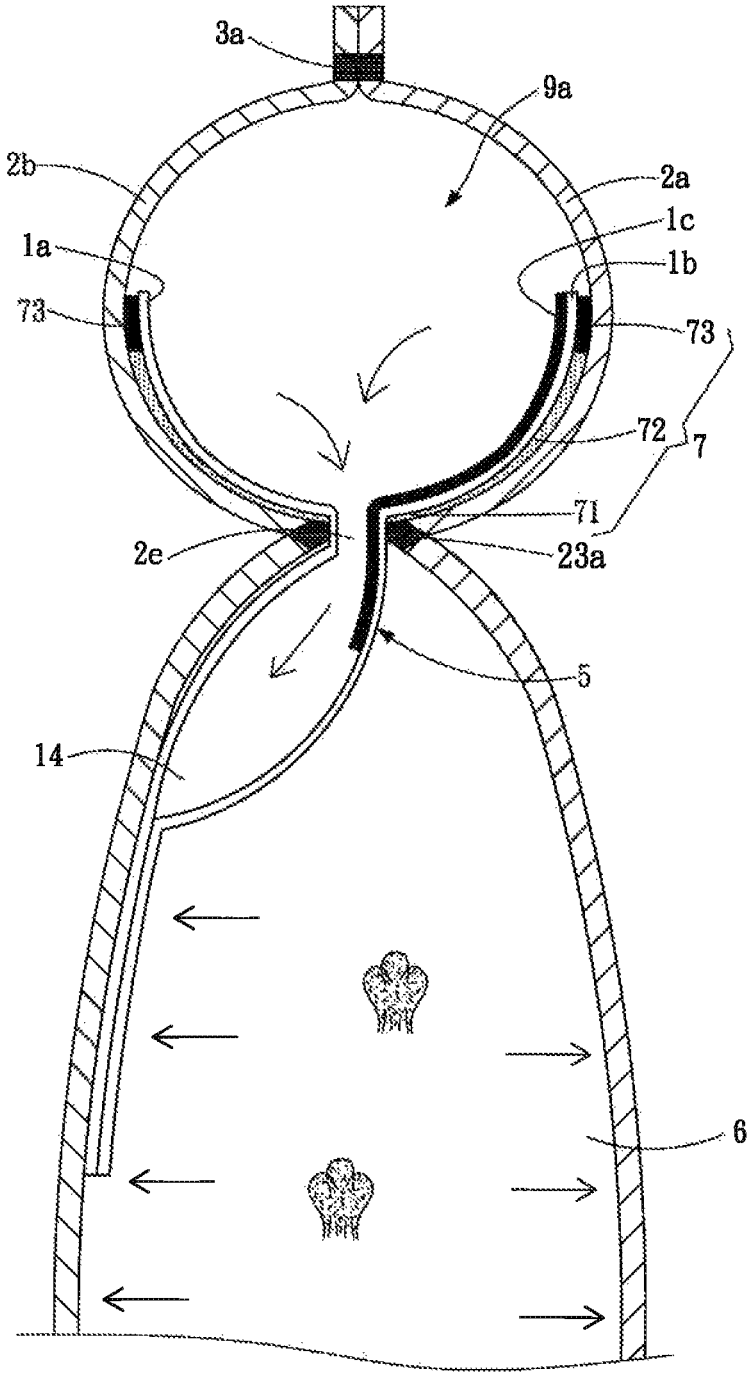
FIG. 4B is a schematic cross-sectional view of the A-N portion in FIG. 2B.

Furthermore, the two outer films 2*a* and 2*b* and the two inner films 1*a* and 1*b* adhere to each other by means of heat sealing, and a plurality of heat-sealing blocks 5 is formed at the predetermined position of a side of a plurality of air inlets 2*e*. Herein, the heat-sealing block 5 is roughly in a strip shape, a part thereof is located in the air filling passage 9, and a part thereof is located in the air column 6 (as shown in FIG. 2B). Furthermore, an air guiding passage 4 is formed between two adjacent heat-sealing blocks 5, and the air guiding passage 4 is located between the two inner films 1*a* and 1*b* and is connected to an air inlet 2*e* (as shown in FIG. 4A and FIG. 4B). As a whole, two adjacent heat-sealing blocks 5 are roughly in a peak shape, and the air guiding passage 4 is roughly in a valley shape.

Figure 3A:
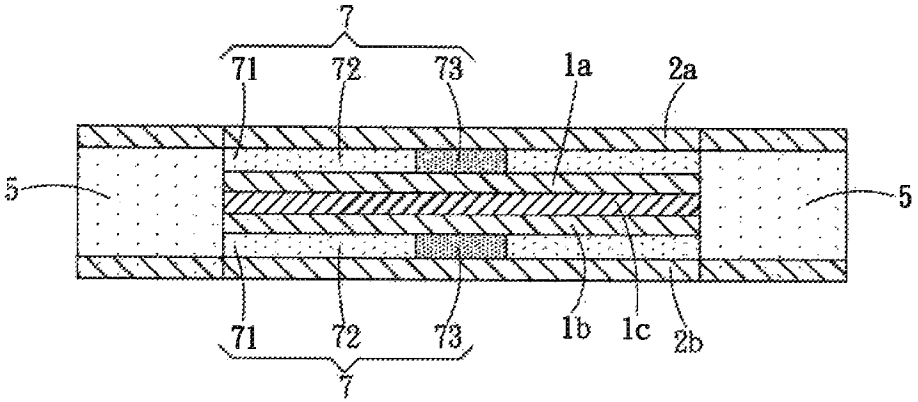
FIG. 3A is a schematic cross-sectional view before air filling in the D direction in FIG. 2B.
Figure 3B:
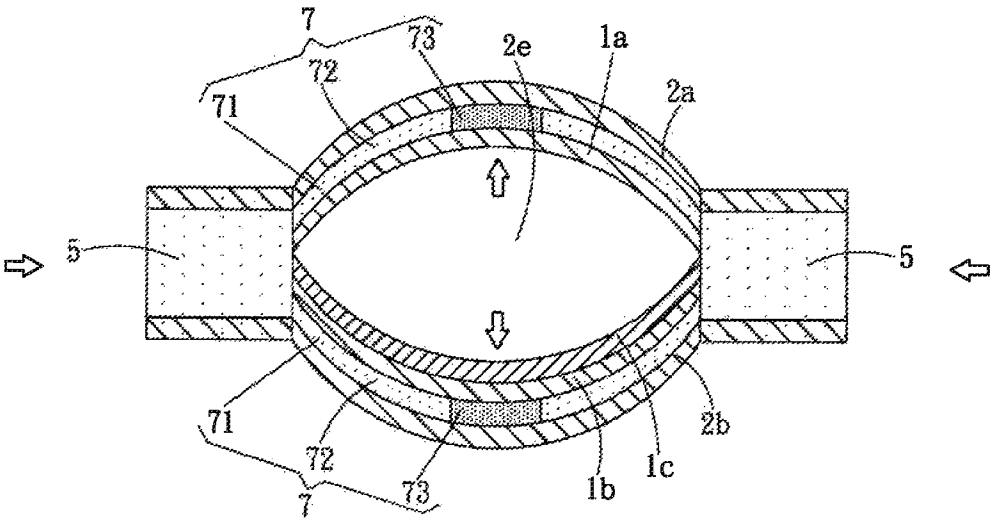
FIG. 3B is a schematic cross-sectional view after air filling in the D direction in FIG. 2B.

A user only must blow air in alignment with the air-filling port 9*a* during use. After the air entering the air-filling port 9*a* expands the air filling passage 9, the two outer films 2*a* and 2*b* are pulled apart outward in the longitudinal direction. The two outer films 2*a* and 2*b* are expanded from a plane state into a three-dimensional shape having a radian (as shown in FIG. 3A), the portion not configured with the heat-sealing block 5 is expanded due to air filling, and the portion configured with the heat-sealing block 5 is not expanded due to air filling, so the air filling passage 9 is contracted in the transverse direction due to a natural fall of level during air filling (as shown in FIG. 3B), so that the two outer films 2*a* and 2*b* forming the air filling passage 9 are contracted in the transverse direction to displace, so as to thrust the two inner films 1*a* and 1*b* by use of the heat-sealing block 5, and the third segment 73 drives the two inner films 1*a* and 1*b* to be pulled apart outward in the longitudinal direction with the two outer films 2*a* and 2*b*, thereby automatically opening the air inlet 2*e* (as shown in FIG. 4A and FIG. 4B). Namely, the heat-sealing block 5 roughly in a peak shape is thrust to the air guiding passage 4 in a valley shape, the third segment 73 drives the two inner films 1*a* and 1*b* to be pulled apart outward in the longitudinal direction as the two outer films 2*a* and 2*b*, and the two inner films 1*a* and 1*b* of the air guiding passage 4 are pulled apart outward, so that the gap formed by coating the heat resisting material 1*c* on the two inner films 1*a* and 1*b* first and then performing heat sealing on the two inner films 1*a* and 1*b* is naturally thrust open.

When the air inlet 2*e* is automatically opened, an air filling passage 9 may fill air for a plurality of air columns 6 simultaneously, and it is not required to fill air after the air inlet 2*e* is positioned, so air filling time may be saved. The air columns 6 are independent of each other, so even if some air columns 6 are damaged, the whole cushioning effect of the air-sealed body 1 is not influenced. Furthermore, the user may fill air for all the air columns 6 only in need of blowing air in alignment with the air-filling port 9*a*, and it is not required to use a high-pressure air filling machine, so that the air filling operation is simpler and more convenient.

After the filled air enters the air column 6 through the air guiding passage 4 and the air inlet 2*e*, the internal air pressure of the air column 6 presses the second sides 12 of the two inner films 1*a* and 1*b*, so that the two inner films 1*a* and 1*b* are attached together to close the air column 6, and the air is not leaked so as to achieve the effect of closing the air. Herein, the two inner films 1*a* and 1*b* are pressed by the air and are suspended in the air column 6, or the two inner films 1*a* and 1*b* may adhere to the outer film 2*a* or 2*b*, and after entering the air column 6, the air presses the two inner films 1*a* and 1*b* to attach the outer film 2*a* or 2*b* so as to close the air column 6.

Please refer to FIG. 2B, in which in some implementation aspects, the two inner films 1*a* and 1*b* may adhere to each other by means of heat sealing to form an air-filling passage 14. Herein, an air-filling passage 14 is formed between the neck heat-sealing line 7 and the second side 12 after the two inner films 1*a* and 1*b* adhere to each other through heat sealing, and the air-filling passage 14 may be mainly formed of a collecting area 141, a guiding area 142 and a shunting area 143. The collecting area 141 is adjacent to the neck heat-sealing line 7 and formed between two longitudinal heat-sealing lines 3*d*, and one end of the collecting area 141 protrudes toward the air filling passage 9; the guiding area 142 is connected to the collecting area 141, and may provide more than one path for the air to flow; the shunting area 143 is connected to the guiding area 142 and the second side 12; the shunting area 143 has a plurality of paths, and the number of paths thereof is greater than the number of paths provided by the guiding area 142; each path of the shunting area 143 has an outlet 143*a*, and the outlet 143*a* is smaller than the portion where the shunting area 143 and the guiding area 142 are connected. Consequently, after the air enters the air-filling passage 14 from the air inlet 2*e*, the air is first collected at the collecting area 141, then flows to the shunting area 143 through the paths provided by the guiding area 142, and then enters the air column 6 along the shunting area 143. The outlet 143*a* is smaller than the portion where the shunting area 143 and the guiding area 142 are connected, so the air in the air column 6 does not flow back through the outlet 143*a* to cause the air leakage problem.

Figure 5A:
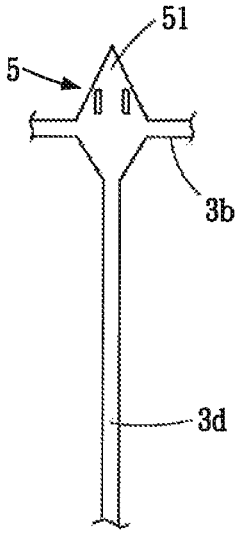
FIG. 5A is a schematic view (1) of a heat-sealing block according to a second embodiment of the present invention.
Figure 5B:
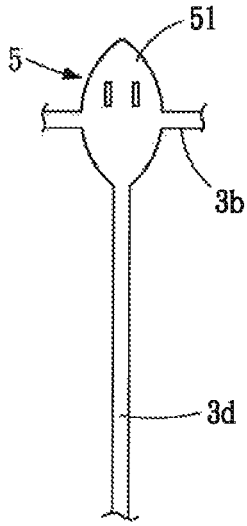
FIG. 5B is a schematic view (2) of a heat-sealing block according to the second embodiment of the present invention.

Please refer to FIG. 5A and FIG. 5B, in which a second embodiment of a mouth-blown air-sealed body with an automatically opened air inlet according to the present invention is shown.

In this embodiment, the heat-sealing block 5 may be provided with an air guiding portion 51, where the air guiding portion 51 has a plane or cambered surface gradually expanding from the top end (close to the heat-sealing line 3*a*), to the bottom end (close to the heat-sealing line 3*b*), and is disposed in the air filling passage 9. After the air entering the air-filling port 9*a* expands the air filling passage 9, the air guiding portion 51 may guide the air in the air filling passage 9 to enter the air guiding passage 4 and the air inlet 2*e*, thereby effectively improving the air filling rate.

Figure 6:
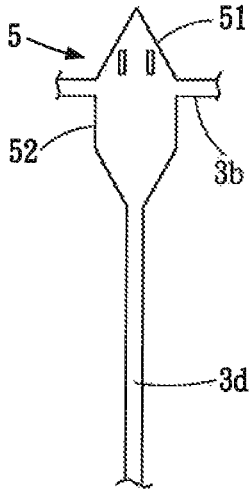
FIG. 6 is a schematic view of a heat-sealing block according to a third embodiment of the present invention.

Please refer to FIG. 6, in which a third embodiment of a mouth-blown air-sealed body with an automatically opened air inlet according to the present invention is shown.

In this embodiment, the heat-sealing block 5 may be connected to a strip-shaped positioning portion 52 at the bottom end of the air guiding portion 51. Herein, the positioning portion 52 adheres to the first sides 11 of the two inner films 1*a* and 1*b* and the two outer films 2*a* and 2*b*, and the heat-sealing line 3*b* is located in the positioning portion 52 so that the air inlet 2*e* is located at a side of the positioning portion 52.

Therefore, in the manufacturing process, even if the two inner films 1*a* and 1*b* or a heat sealing mold deviates and does not depart from the range of the positioning portion 52, the two inner films 1*a* and 1*b* and the two outer films 2*a* and 2*b* may adhere to each other through heat sealing along the heat-sealing line 3*b* without influencing the structure of the air inlet 2*e* and the air filling function thereof, so as to solve the problem that a conventional sealed body cannot be filled with air after heat sealing because the air valve deviates.

Furthermore, in the present invention, the air guiding portion 51 may also adheres to the first sides 11 of the two inner films 1*a* and 1*b* and the two outer films 2*a* and 2*b*, the heat-sealing line 3*b* is located in the air guiding portion 51 and is not located at the top end of the air guiding portion 51, so that the air inlet 2*e* is located at a side of the air guiding portion 51.

The aforementioned air columns 6 may be connected to one or more air inlets 2*e*, each air inlet 2*e* may further be connected to one or more air-filling passages 14, and the air columns may be in communication with each other, and may further share one or more air-filling passages 14.

Figure 7:
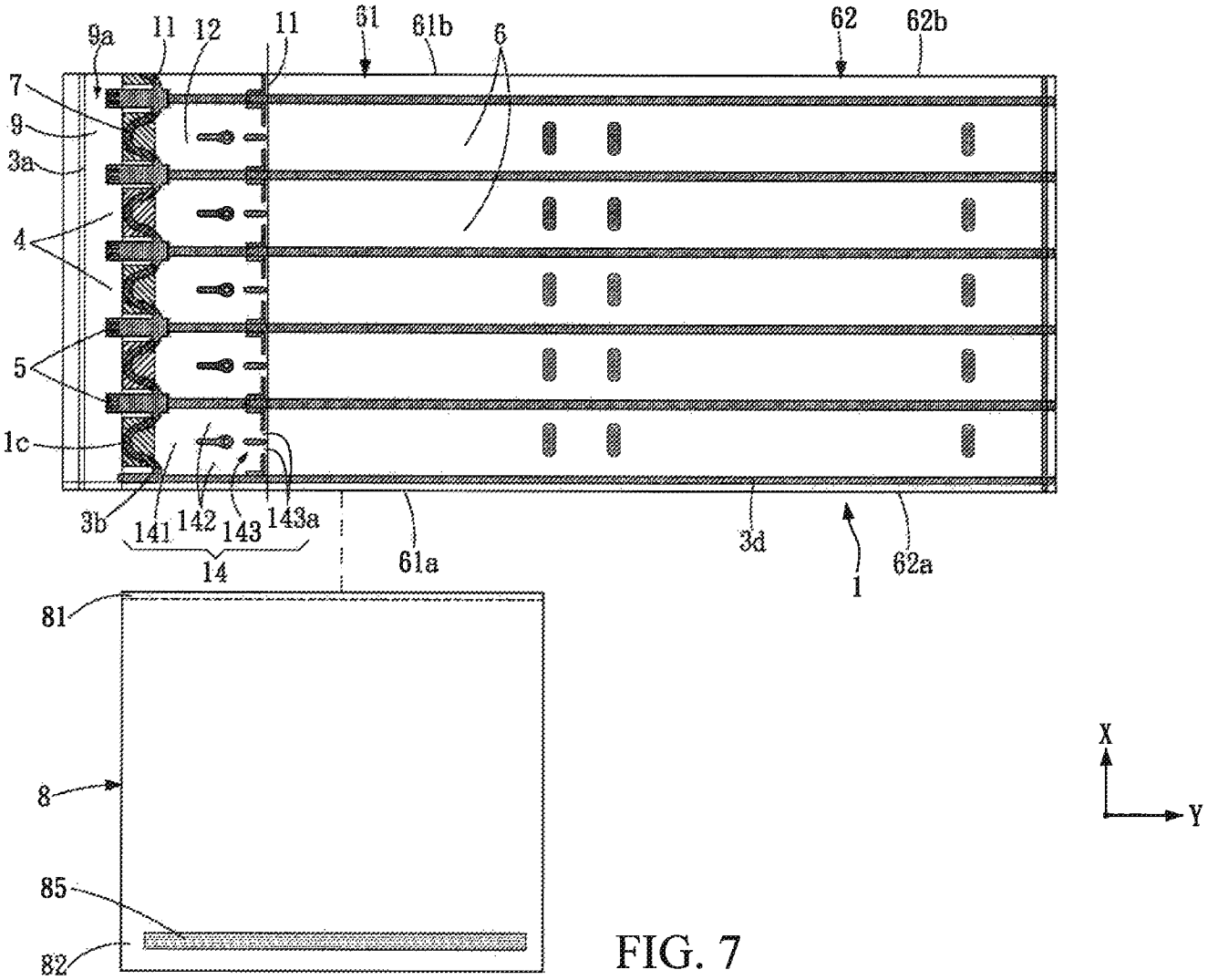
FIG. 7 is a schematic front view (1) according to a fourth embodiment of the present invention.
Figure 8:
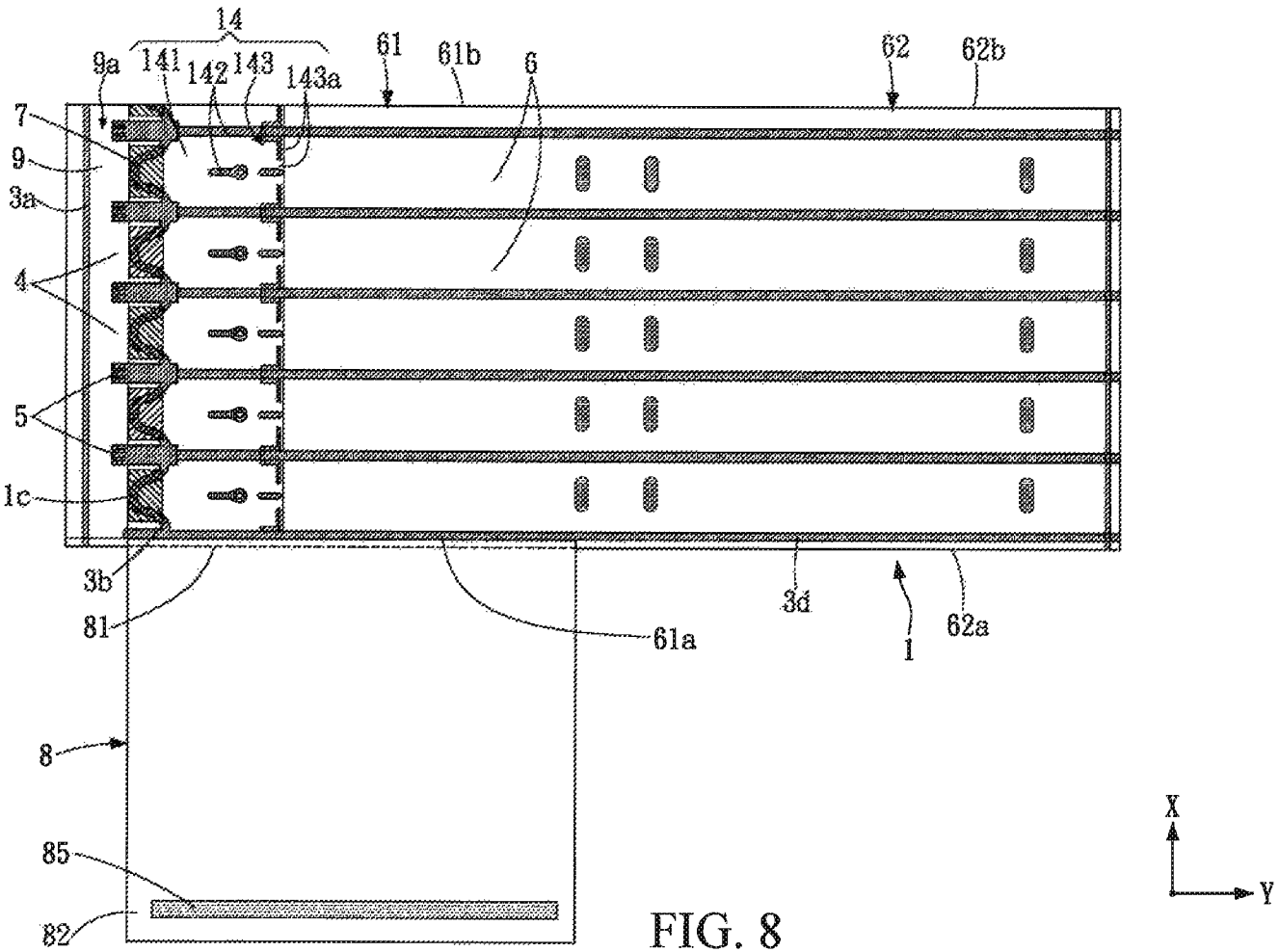
FIG. 8 is a schematic front view (2) according to the fourth embodiment of the present invention.

Please refer to FIG. 7 and FIG. 8, in which a fourth embodiment of a mouth-blown air-sealed body with an automatically opened air inlet according to the present invention is shown.

A plurality of air columns 6 is sequentially disposed adjacent to each other in the arrangement direction X, and is divided into a first cushioning air column portion 61 and a second cushioning air column portion 62 in the long axis direction Y of the plurality of air columns 6. Herein, the first cushioning air column portion 61 has a first fixing side 61*a* and a first opening side 61*b*, and the first fixing side 61*a* and the first opening side 61*b* are located at two ends of the first cushioning air column portion 61 in the arrangement direction X; the second cushioning air column portion 62 has a second fixing side 62*a* and a second opening side 62*b*, and the second fixing side 62*a* and the second opening side 62*b* are located at two ends of the second cushioning air column portion 62 in the arrangement direction X.

A band 8 has a fixing end 81 and a positioning end 82, where the fixing end 81 is fixed at the first fixing side 61*a* of the first cushioning air column portion 61, and the length of the band 8 is not less than the length of the first cushioning air column portion 61 in the arrangement direction. In this embodiment, the length of the band 8 is the same as the length of the first cushioning air column portion 61 in the arrangement direction. In order to achieve the waterproof purpose, the band 8 may also be made of other waterproof materials. Furthermore, the band 8 may be provided with a sticking part 85 at the positioning end 82, such as adhesive or Velcro, but the present invention is not limited thereto.

Please refer to FIG. 7 and FIG. 8, in which after the air column sheet is bent, the first cushioning air column portion 61 and the second cushioning air column portion 62 are stacked together, heat sealing is performed on a side where the first cushioning air column portion 61 and the second cushioning air column portion 62 are not in communication with each other, and heat sealing is performed on the first fixing side 61*a* and the second fixing side 62*a* to enable the first fixing side 61*a* and the second fixing side 62*a* to adhere to each other and be fixed, so that the first opening side 61*b* and the second opening side 62*b* surround to form an opening 60.

Figure 9:
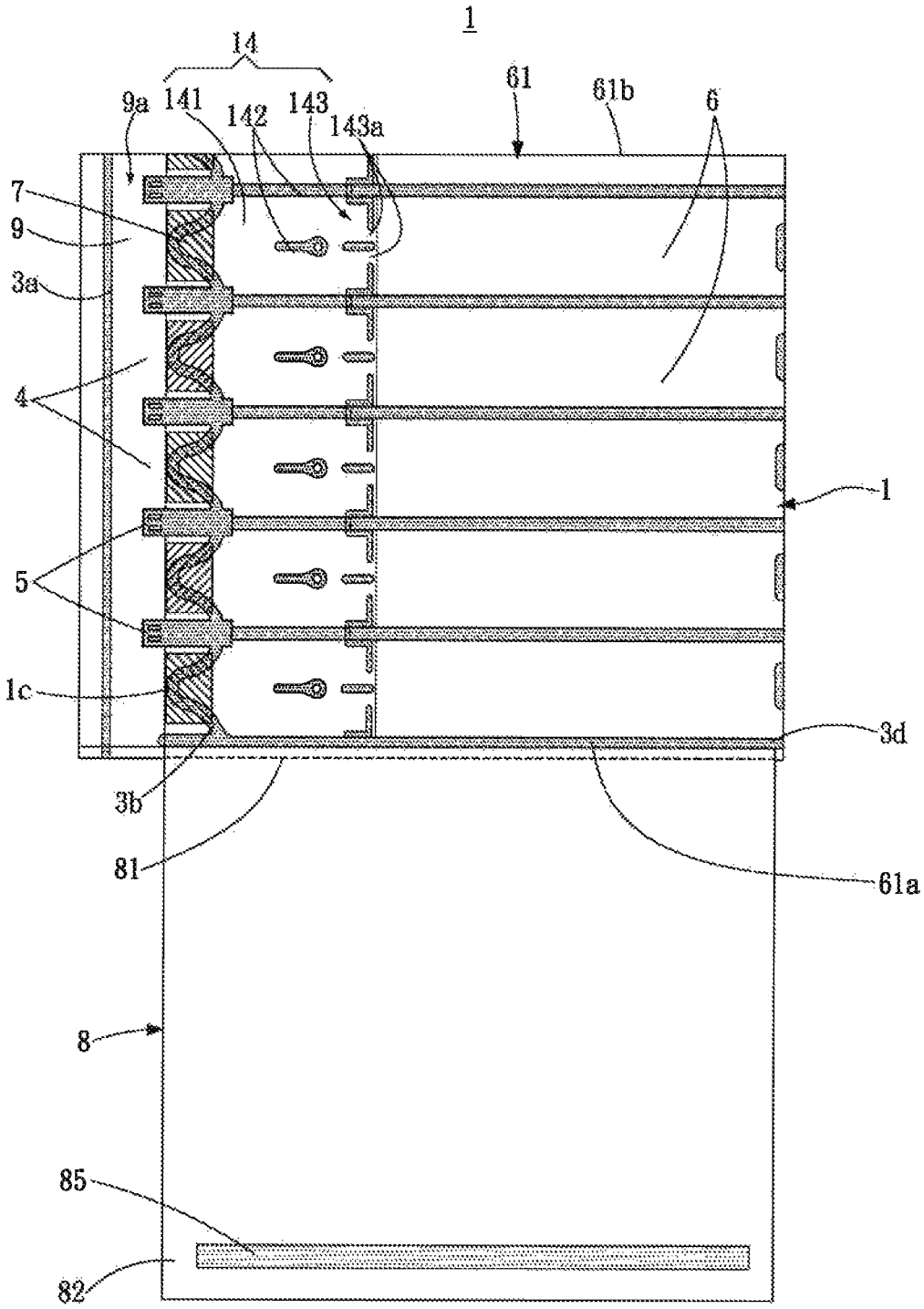
FIG. 9 is a schematic front view (3) according to the fourth embodiment of the present invention.

Please refer to FIG. 9, in which after the air column sheet is filed with air in the aforementioned air filling manner, the air column 6 of the first cushioning air column portion 61 and the second cushioning air column portion 62 is filled with air and expanded, and is changed from a stacked sheet shape in a non-air filling state (as shown in FIG. 2A), into a three-dimensional column shape in an air filling and expanding state (as shown in FIG. 4A). In other words, the two outer films 2*a* and 2*b* are expanded due to air filling, are pulled apart outward, and are changed into a three-dimensional shape, so that the length of the first cushioning air column portion 61 and the second cushioning air column portion 62 is shortened in the arrangement direction. The band 8 is in a sheet structure, and the length thereof is not changed after the air column sheet 2 is filled with air and expanded; but the length of the first cushioning air column portion 61 and the second cushioning air column portion 62 is shortened in the arrangement direction, so in the air filling and expanding state, the length of the band 8 in the arrangement direction is greater than the length of the first cushioning air column portion 61 or the second cushioning air column portion 62.

Figure 10:
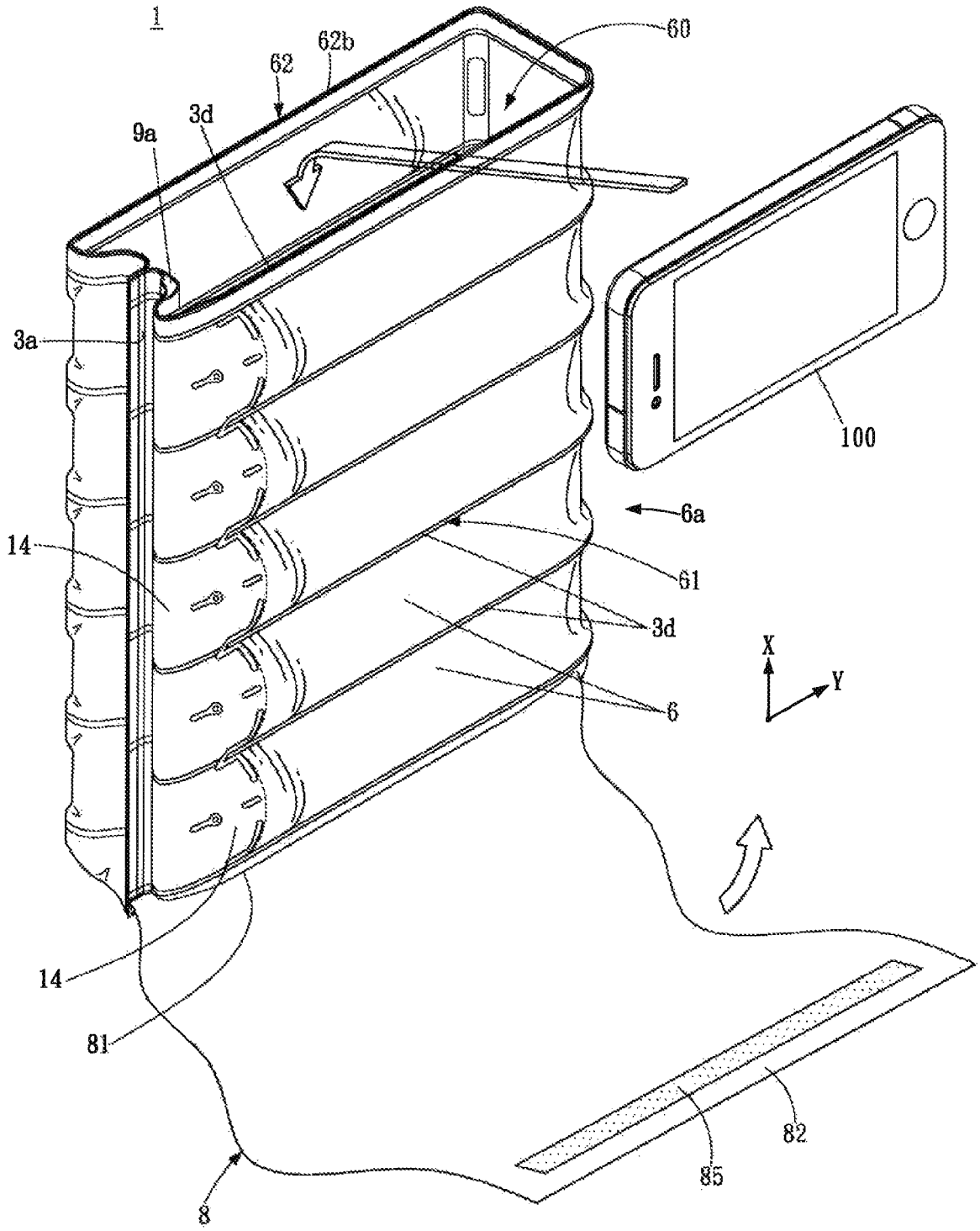
FIG. 10 is a schematic external view of accepting an article according to the fourth embodiment of the present invention.
Figure 11:
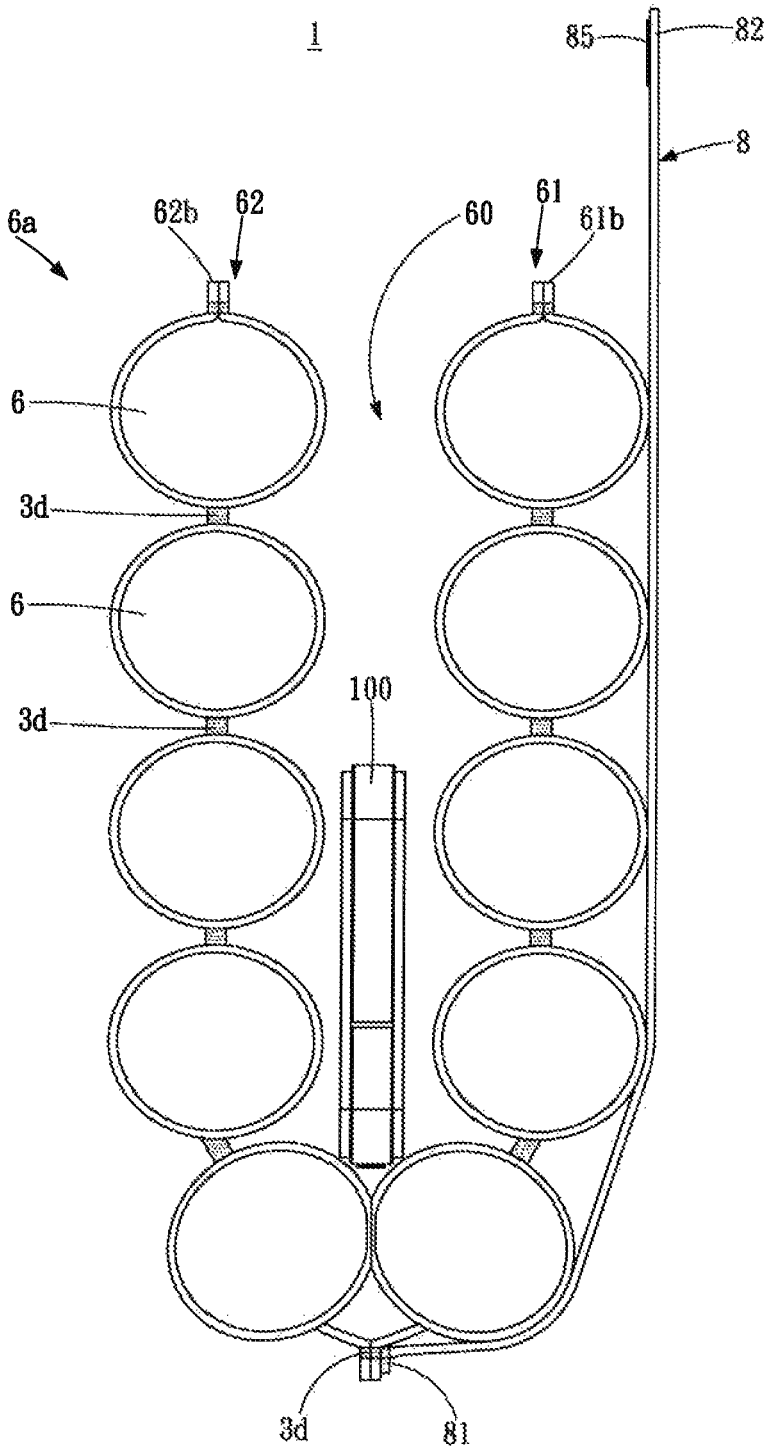
FIG. 11 is a schematic lateral view of accepting an article according to the fourth embodiment of the present invention.

Please refer to FIG. 10, in which the air column sheet forms a bag body, and an accommodating space capable of accepting an article 100 exists between the first cushioning air column portion 61 and the second cushioning air column portion 62. Please refer to FIG. 10, FIG. 11, FIG. 12, and FIG. 13, in which after the user places the article 100 into the space between the first cushioning air column portion 61 and the second cushioning air column portion 62, the band 8 rolls from the first cushioning air column portion 61 to the second cushioning air column portion 62, so that the sticking part 85 of the band 8 attaches the positioning end 82 thereof to the second cushioning air column portion 62, thereby shielding the opening 60, and preventing the article 100 from falling off from the space between the first cushioning air column portion 61 and the second cushioning air column portion 62.

Figure 12:
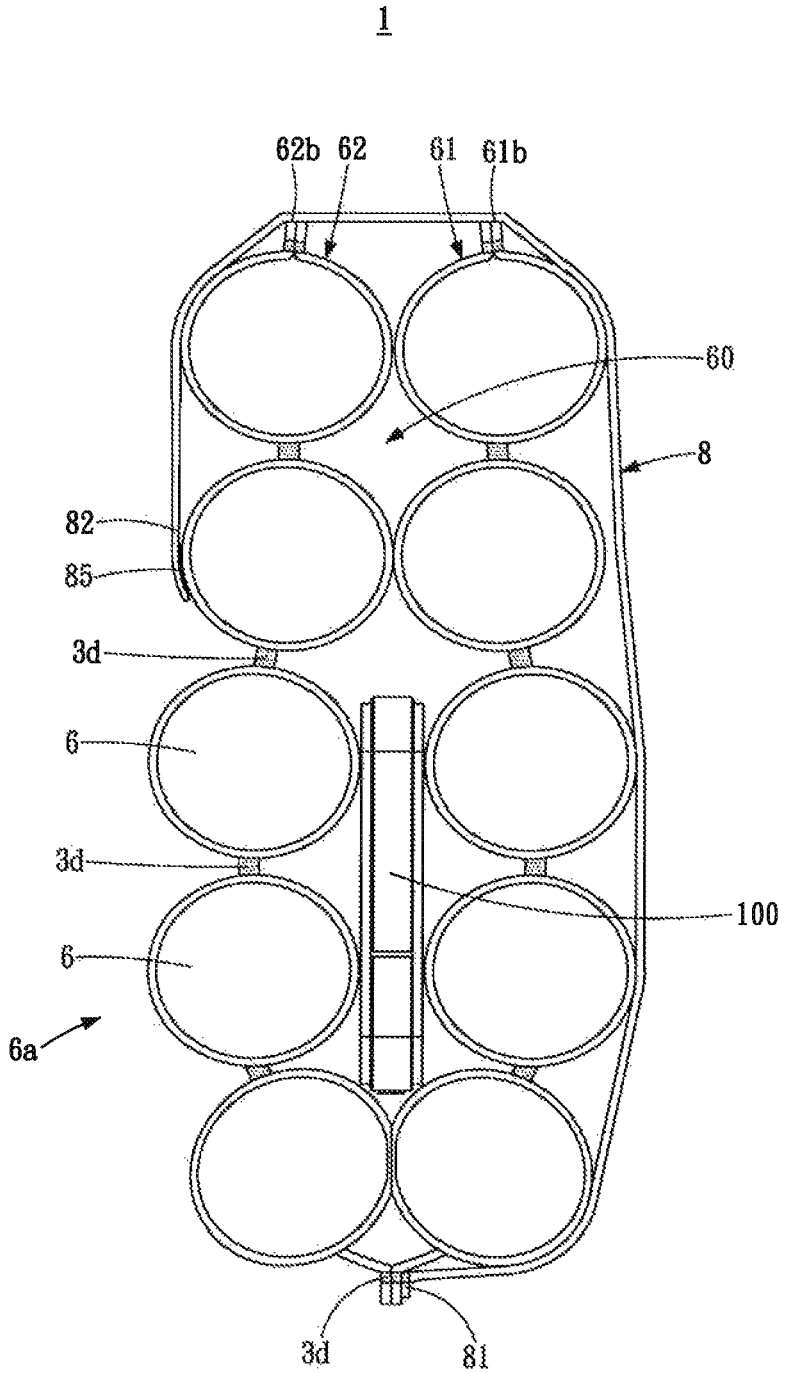
FIG. 12 is a schematic lateral view of sealing the opening according to the fourth embodiment of the present invention.
Figure 13:
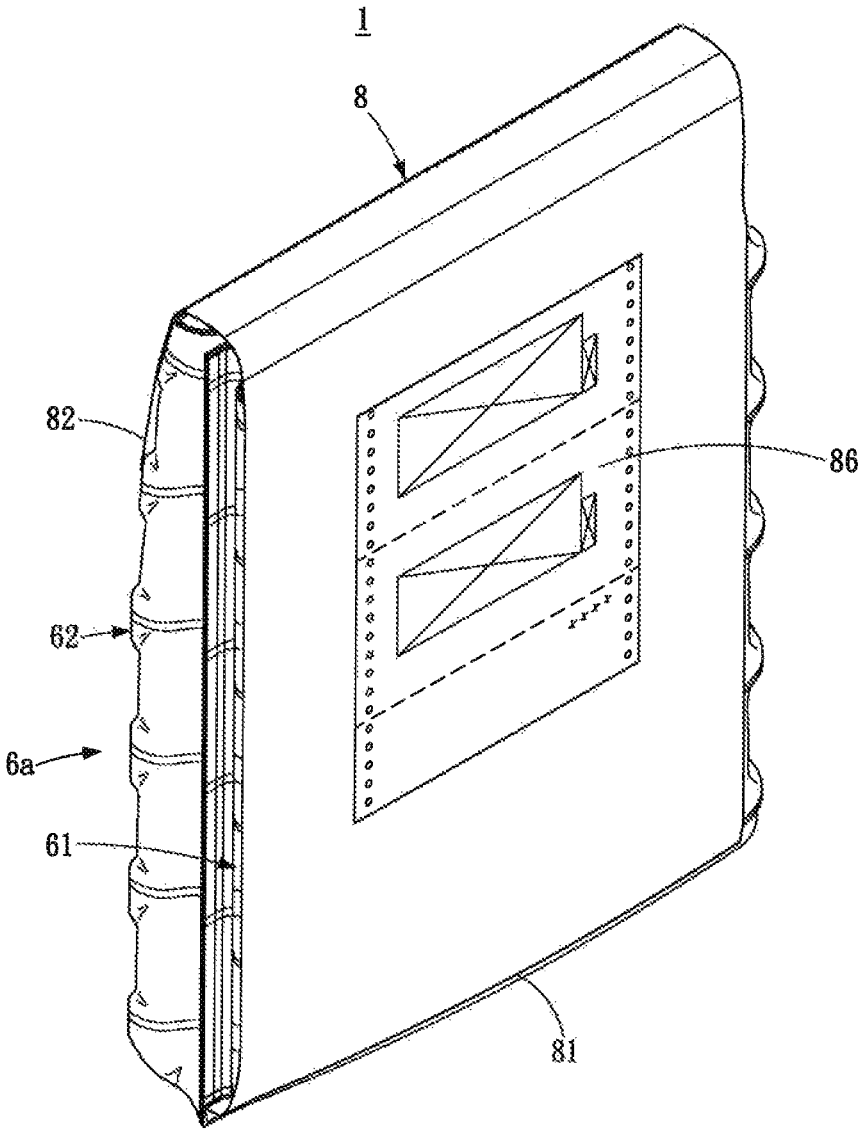
FIG. 13 is a schematic external view of sticking a tag according to the fourth embodiment of the present invention.

It should be particularly noted that, as shown in FIG. 12, When the user bundles the bag by use of the band 8, the user pulls the band 8 tightly to enable the top end of the first cushioning air column portion 61 and the top end of the second cushioning air column portion 62 (close to one end of the opening 60), to tightly adhere together, and therefore, the air column 6 tightly covers the article 100, which may effectively prevent the article 100 from shaking in the space between the first cushioning air column portion 61 and the second cushioning air column portion 62 during transportation. Further, according to the size of the article 100, the band 8 may adjust the sticking position to bundle the first cushioning air column portion 61 and the second cushioning air column portion 62 tightly, so that the air column 6 may tightly cover the article 100 of different sizes, thereby enhancing the sending convenience, and it is unnecessary to change the size of the postal envelope bag as the size of the article differs.

In some implementation aspects, the band 8 may be provided with a tag 86, and the user may write or print recipient information and sender information on the tag, or record transportation notes on the tag, for convenience of sending.

Figure 14:
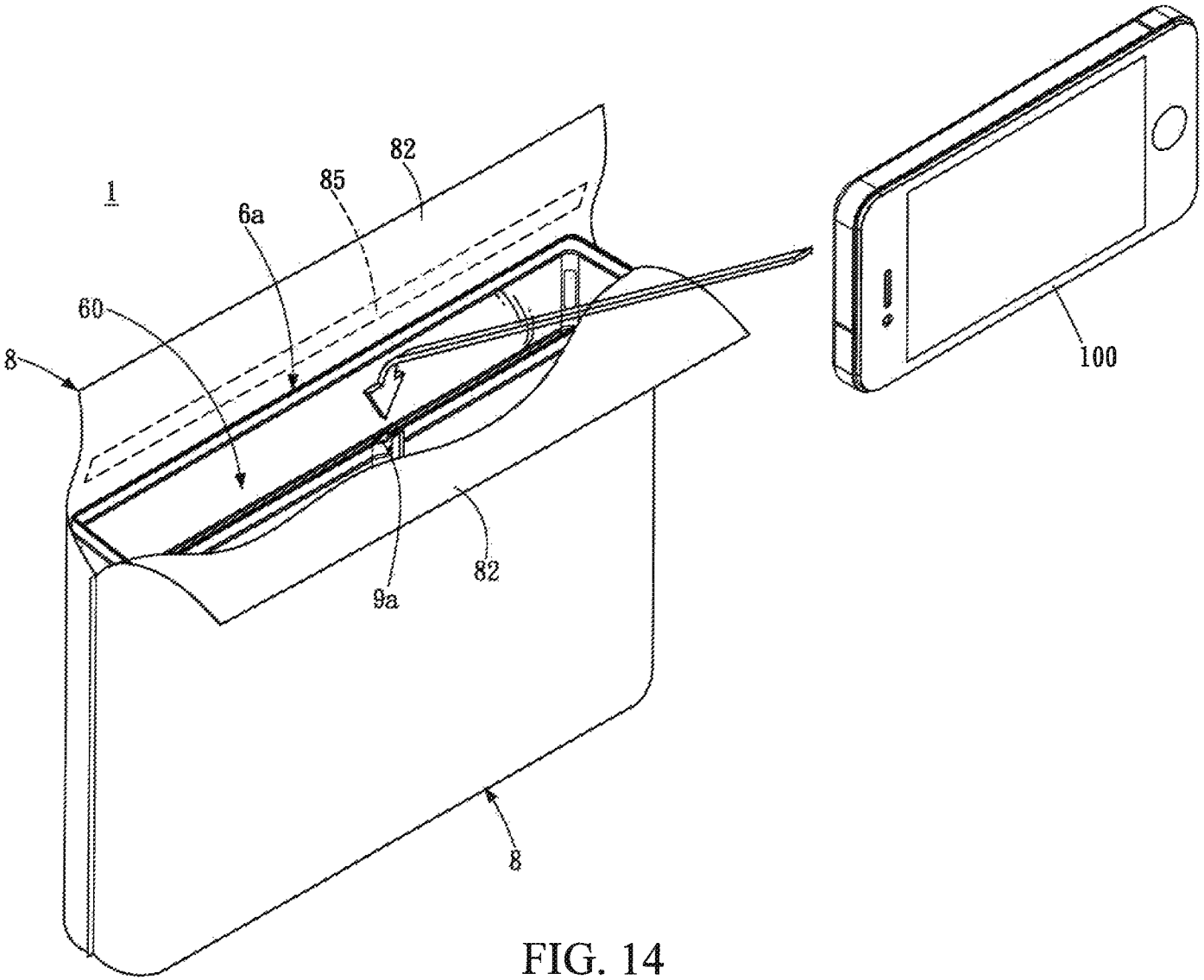
FIG. 14 is a schematic external view of accepting an article according to a fifth embodiment of the present invention.
Figure 15:
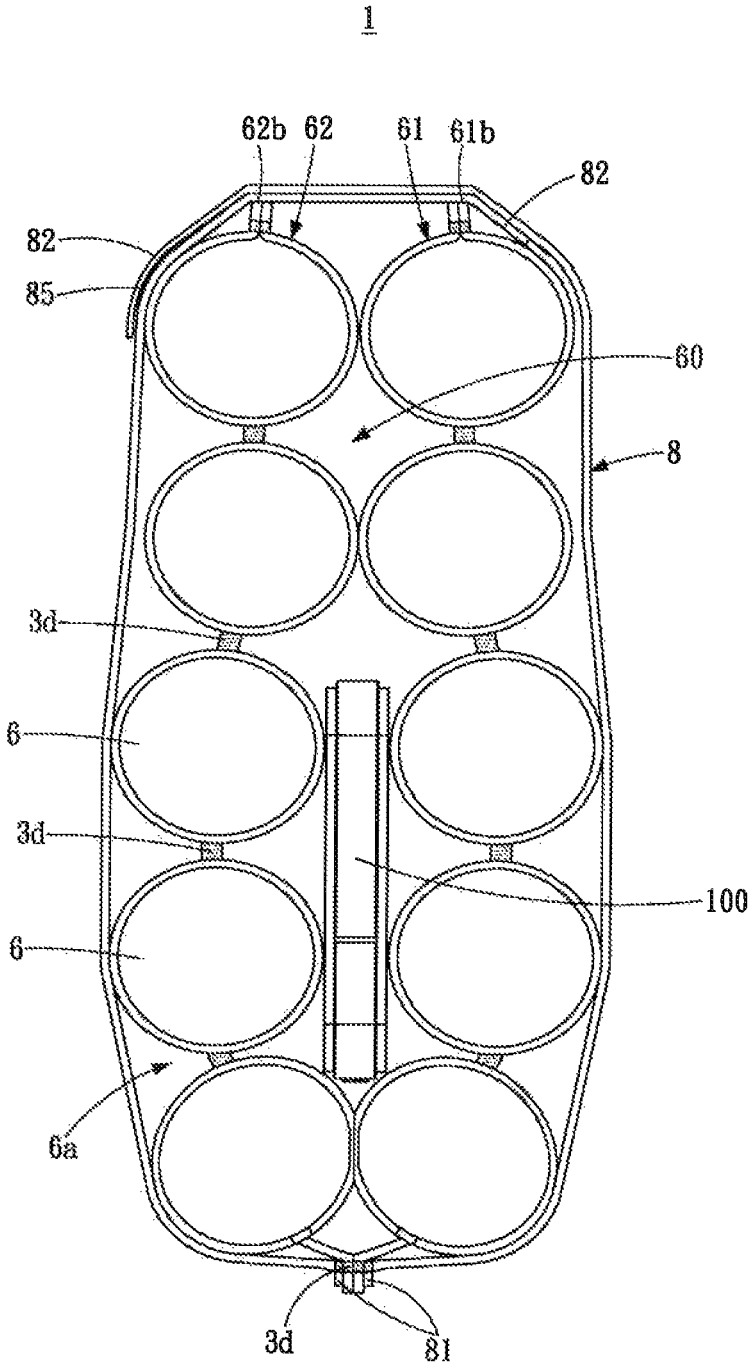
FIG. 15 is a schematic lateral view of sealing the opening according to the fifth embodiment of the present invention.

Please refer to FIG. 14 and FIG. 15, in which in some implementation aspects, a side of the air column 6 may be provided with a plurality of bands 8, and the plurality of bands 8 forms a bag body, so as to place the article 100 into the space between the first cushioning air column portion 61 and the second cushioning air column portion 62. In other words, the position of the band 8 may be adjusted as the structure differs.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A mouth-blown air-sealed body with an automatically opened air inlet, comprising:

two outer films, stacked together vertically;

two inner films, positioned between the two outer films, wherein each of the inner films comprises a first side and a second side opposite to each other;

a plurality of heat resisting materials, coated between the first sides of the two inner films;

a plurality of transverse heat-sealing lines, adhering to two sides of the two outer films;

a plurality of longitudinal heat-sealing lines, adhering to the two outer films and the two inner films;

a plurality of air columns, wherein each of the air columns is located between the two outer films of two adjacent longitudinal heat-sealing lines;

a plurality of neck heat-sealing lines, located between the transverse heat-sealing lines, wherein each of the neck heat-sealing lines is corresponding to one of the air columns and comprises:

two first segments, respectively connected to two adjacent longitudinal heat-sealing lines;

two second segments, respectively connected to the first segments, and extending toward a direction far away the air columns, wherein at least one part of the two second segments is located at portions of the two inner films coated with the heat resisting materials; and a third segment, connected to the two second segments, and located at the portions of the two inner films coated with the heat resisting materials, where, the neck heat-sealing line located at the portions of the two inner films coated with the heat resisting materials adheres to one of the outer films and one of the inner films adjacent to each other;

an air filling passage, located at a space in the two outer films between one of the transverse heat-sealing lines and one of the neck heat-sealing lines, and comprising an air-filling port capable of filling air;

a plurality of air inlets, formed at the portions of the two inner films coated with the heat resisting materials, and used for communicating with the air filling passage and the air columns; and a plurality of heat-sealing blocks, adhering to the two outer films and the two inner films by means of heat sealing, and formed at sides of the air inlets, wherein air entering the air-filling port expands the air filling passage, the two outer films are pulled apart outward in a longitudinal direction and are contracted in a transverse direction; the heat-sealing blocks thrust the two inner films, the portions of the two inner films coated with the heat resisting material are pulled apart outward in the longitudinal direction, and the third segments drive the two inner films to open the air inlet as the two outer films are pulled apart outward in the longitudinal direction; after entering the air column, the air presses the second sides of the two inner films to close the air column.

2. The mouth-blown air-sealed body with an automatically opened air inlet according to claim 1, wherein the two inner films adhere to each other through heat sealing between the neck heat-sealing line and the second side to form an air-filling passage, and the air-filling passage comprises:

a collecting area, adjacent to the neck heat-sealing line and formed between two of the longitudinal heat-sealing lines, wherein one end of the collecting area protrudes toward the air filling passage;

a guiding area, connected to the collecting area; and a shunting area, connected to the guiding area and the second side, wherein the shunting area comprises a plurality of outlets, and the outlets are smaller than a portion where the shunting area and the guiding area are connected.

3. The mouth-blown air-sealed body with an automatically opened air inlet according to claim 1, wherein the heat-sealing block comprises at least one air guiding portion, located at the air filling passage, and used for guiding air in the air filling passage to enter the air inlet.

4. The mouth-blown air-sealed body with an automatically opened air inlet according to claim 3, wherein the heat-sealing block comprises a positioning portion connected to the air guiding portion, and the air inlets is located at a side of the positioning portion.

5. The mouth-blown air-sealed body with an automatically opened air inlet according to claim 4, wherein the positioning portion or the air guiding portion adheres to the first sides of the two inner films and the two outer films.

6. The mouth-blown air-sealed body with an automatically opened air inlet according to claim 1, further comprising: a band, comprising a fixing end and a positioning end, wherein the fixing end is fixed at one end of the two outer films, and the length of the band is not less than the length of the two outer films in the transverse direction.

7. The mouth-blown air-sealed body with an automatically opened air inlet according to claim 6, wherein the width of the band is less than or equal to the width of the two outer films.

8. The mouth-blown air-sealed body with an automatically opened air inlet according to claim 6, further comprising: a tag, located on the band.

9. The mouth-blown air-sealed body with an automatically opened air inlet according to claim 6, wherein the band comprises a sticking part located at the positioning end.

* * * * *